US007347755B1

(12) United States Patent
Katzfey

(10) Patent No.: US 7,347,755 B1
(45) Date of Patent: Mar. 25, 2008

(54) SECTIONALIZED SURFBOARD

(76) Inventor: Lance J. Katzfey, 17235 Libertad Dr., San Diego, CA (US) 92127

( * ) Notice: Subject to any disclaimer, the term of this patent is extended or adjusted under 35 U.S.C. 154(b) by 0 days.

(21) Appl. No.: 11/701,885

(22) Filed: Feb. 2, 2007

(51) Int. Cl.
*B63B 35/79* (2006.01)
*B63B 7/04* (2006.01)

(52) U.S. Cl. ..... 441/74; 114/352

(58) Field of Classification Search ..... 114/39.12, 114/39.14, 77 R, 77 A, 352, 353; 441/65, 441/68, 73, 74, 79
See application file for complete search history.

(56) References Cited

U.S. PATENT DOCUMENTS

| | | | |
|---|---|---|---|
| 3,137,873 | A | 6/1964 | Garrolini |
| 3,287,754 | A | 11/1966 | Price et al. |
| 3,409,920 | A | 11/1968 | Brownley |
| 4,807,549 | A | 2/1989 | Rhodes et al. |
| 5,476,403 | A | 12/1995 | Hsia |
| 5,711,692 | A | 1/1998 | Pope |
| 7,029,350 | B2 | 4/2006 | Katzfey |

FOREIGN PATENT DOCUMENTS

| | | | |
|---|---|---|---|
| DE | 3218236 | A1 * | 11/1983 |
| EP | 52783 | A1 * | 6/1982 |
| FR | 2572703 | A1 * | 5/1986 |

* cited by examiner

*Primary Examiner*—Ajay Vasudeva

(57) ABSTRACT

A sectionalized surfboard, which can be dismantled into sections and rejoined for use. The sections are joined using two vertically installed bolts, which pass through two joining assemblies. Each bolt is inserted through a hole in a top metal plate and tightened in a threaded hole in a bottom metal plate molded in a plastic molding, which is glued to the board internal foam and to the top and bottom skins on one section. The bolt also passes through a tube molded in a second plastic molding, which is glued to the board internal foam and to the top and bottom skins of the other section. The two joining assemblies are installed near the sides of the board.

4 Claims, 5 Drawing Sheets

SECTIONALIZED SURFBOARD

BACKGROUND

1. Field of Invention

This invention relates to a method for building a sectionalized, dissassemblable surfboard or sailboard. This invention is designed for boards made without a lengthwise stringer and typically uses two bolts to assemble the sections.

2. Prior Art

With the popularity of surfboards and sailboards there is a need to improve the transportability of the boards. Surfboards and sailboards do not fit into most vehicles, so a roof rack is required for transporting. In addition to the difficulty of adequately tying down the board, it is easy for someone to steal the board off the roof rack. In addition, sunlight will fade the colors and ages the plastic of the board. A sectionalized board, that can be disassembled, will solve these problems. By dividing the board in two or more pieces, the board can be stored inside the vehicle and be locked inside. This saves the time required to tie the board to the roof rack as well as the expense of the rack. The board sections can be stored in the trunk of a car. For storage at home, the disassembled board can easily be stored in a closet and can be maneuvered easily through hallways. To make the assembly acceptable to the user, the assembly and disassembly should only take a few seconds. The assembled board should be as strong as a normal one-piece board with only a small additional weight.

The only successfully marketed sectionalized surfboard design is the design described in U.S. Pat. No. 5,711,692 (1998) to Pope. This design uses clamps and a horizontal tube. The tube fits into receivers in the board sections. One disadvantage is that the tube can bend during use. Another disadvantage is the tube receivers are difficult to make and install into the board. This adds to the cost of making the board. If dirt or sand get into the tube receivers the board can be difficult to assemble or disassemble.

U.S. Pat. No. 5,476,403 (1995) to Hsia describes a sectionalized surfboard, which uses a horizontal pin or bolt to join the sections. This design uses a very long bolt and anchor structures with loops. Since under load, the loops and pin are in tension, the deck of the board must be strong enough to handle the compression loads. The main body of a surfboard is typically made of light foam and significant extra structure must be added to support the loops. U.S. Pat. No. 4,807,549 (1989) to Rhodes et al. describes a sectionalized board design using suitable chevron surfaces and a cable clamp. This board would be very difficult to build with a tight fit and also strong enough. The cable clamping would be difficult to get tight enough to prevent bending.

The sectionalized hull described in U.S. Pat. No. 3,137,873 (1964) to Garrolini discloses a system using telescoping shafts and suitable latches. The sleeves for the shafts would be difficult to mount securely in the surfboard and would add significant weight. In the sectionalized hull disclosed in U.S. Pat. No. 3,287,754 (1966) to Price et al., the hull sections are joined by pairs of clamp assemblies mounted on the upper and lower sides of their respective sections. These clamps would be difficult to install and would be very heavy. Another approach is disclosed in U.S. Pat. No. 3,409,920 (1968) to Brownley who uses a mortise-and-tenon socket and clip arrangement for joining the sections. This design would be difficult to make strong enough.

All these designs are expensive and complicated. They are susceptible to flexing if the parts are not made strong enough or wear with use. They are heavy and difficult to install in a standard surfboard.

The sectionalized surfboard described in my U.S. Pat. No. 7,029,350 (2006) to Katzfey describes a single bolt joining system, which is attached to a central stringer installed in the board. Many of the surfboards made do not have a central stringer and depend on the board skin and sides (rails) of the board to provide strength.

OBJECTS AND ADVANTAGES

The object of the present invention is to provide a sectional surfboard-like board design, which can be adapted to use as a surfboard or windsurfer. This invention is for boards made without a lengthwise stringer. A stringerless board is made with a plastic foam interior, which is covered with a reinforced plastic skin. The board stiffness partially comes form the sides or rails of the board. My design uses two sets of molded plastic joining assemblies, which are glued to the internal foam and to the top and bottom skins of the board. In one embodiment, there are two joining assemblies, which are typically mounted near the left and right sides of the board. My design uses vertically installed bolts to join the board sections. This makes it very easy to assemble and disassemble the board. The joining parts can be retrofitted to an existing board or built into a new board.

Each joining assembly consists of two separate parts. In joining part one, there are top and bottom rectangular metal plates molded in and partially protruding from a molded plastic part. Joining part two is a molded plastic part with a metal tube molded in between recesses for the protruding metal parts of joining part one and mates with joining part one. To assemble the board, the joining bolt is inserted through a hole in the top of joining part two, through the hole in the top rectangular metal plate protruding from joining part one. It then passes through the tube molded in joining part two. The bolt is tightened in a threaded hole in the bottom rectangular metal plate of joining part one to join the joining parts. The molded plastic parts are glued to the foam and to the top and bottom skins of the board, one assembly on each side of the board.

Epoxy surfboards are normally made without a stringer, and instead rely on the sides of the board (rails) to provide stiffness to the board. The joining metal parts are partially molded in a molded plastic to transfer loads from the metal parts to the foam and to the top and bottom skins of the board. By mounting the molded parts near the sides of the board, a short "D" shaped beam is created on each side. My design is easy to install, adds little weight, and is low cost. Assembly and disassembly of each section is done with two bolts and takes only a few seconds.

The joining assembly can also be made with the tube and part of the plastic molding protruding from one mating surface and fitting in a recess in the other mating surface. The top and bottom metal plates are then fully molded in the plastic molding in the second mating surface.

DRAWINGS—FIGURES

In the drawings, where like reference numbers indicate like parts,

DRAWINGS—REFERENCE NUMBERS

Figure 1:
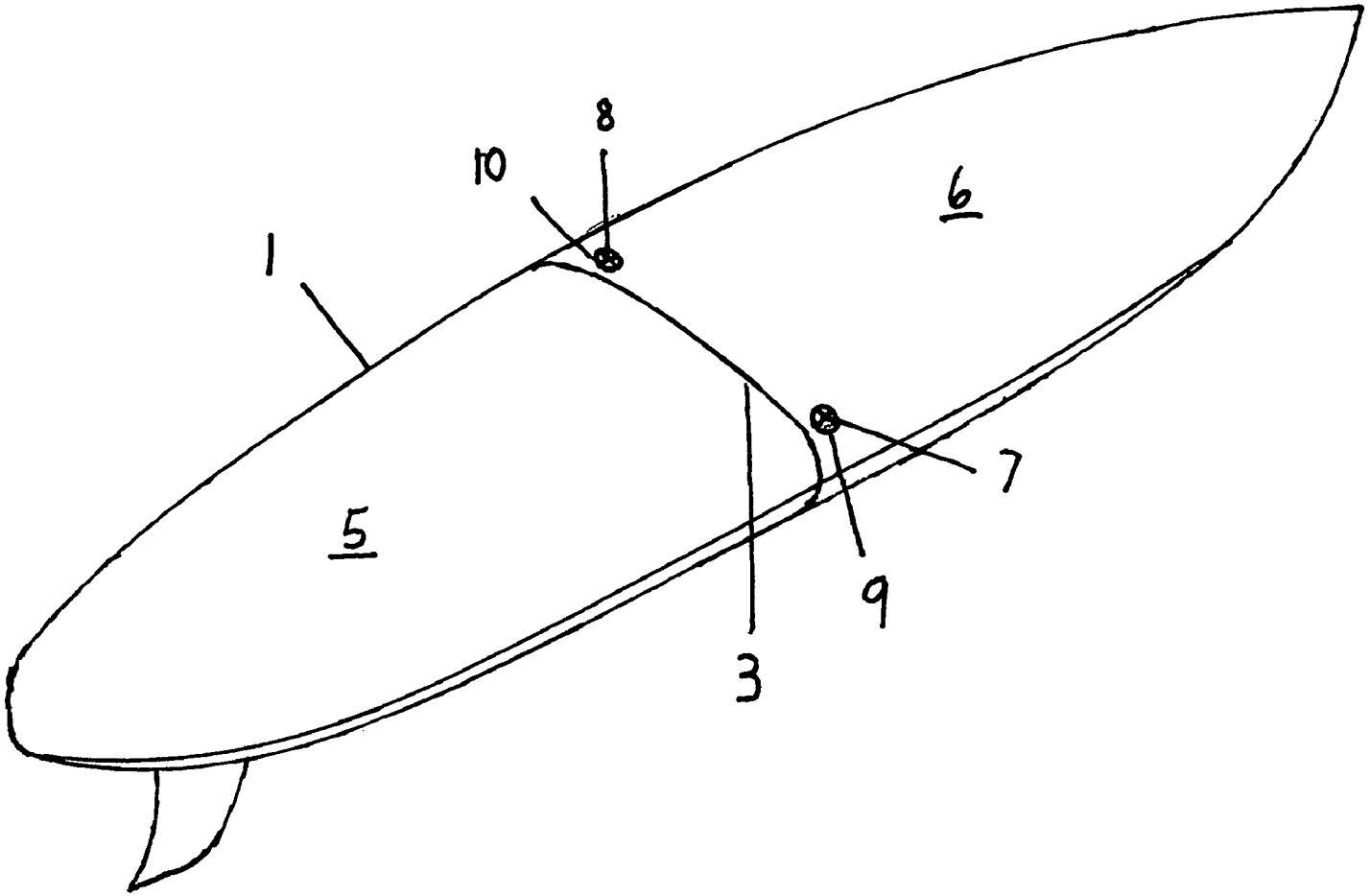
FIG. 1 is a perspective view of a fully assembled two piece sectionalized surfboard in accordance with the present invention.

1 Surfboard
3 Line showing where board divides
5 back section
6 front section
7 removable joining bolt
8 removable joining bolt
9 hole for bolt 7
10 hole for bolt 8
11 top metal plate
12 top metal plate
13 bottom metal plate
14 bottom metal plate
15 top recess in board for top metal plate 11
16 top recess in board for top metal plate 12
17 bottom recess for metal plate 13
18 bottom recess for metal plate 14
19 molded plastic assembly with tube
20 molded plastic assembly with tube
30 molded plastic assembly with protruding metal plates
38 metal tube
40 top metal plate
41 bottom metal plate
60 molded plastic assembly with tube
61 molded plastic assembly with tube
62 metal tube
63 metal tube
66 molded plastic assembly with metal plates
67 molded plastic assembly with metal plates
68 molded recess
69 molded recess

DETAILED DESCRIPTION OF PREFERRED EMBODIMENTS

An embodiment of the present invention will now be described with reference to the drawings. An example of a surfboard divided into two sections will be used to illustrate this embodiment. The invention is not limited to dividing board into two sections. There can be as many sections as desired. The surfboard described is divided near the middle into two sections. Boards made with a similar construction method such as some paddleboards and sailboards could also be adapted to include the first embodiment. A surfboard with more than two sections can be carried in a suitcase for traveling.

FIG. 1 shows the assembled surfboard 1 in accordance with the present invention includes a front section 6, a back section 5, and a joining bolts 7 and 8 (The head of bolt 7 and 8 are recessed respectively into holes 9 and 10 so only the heads of bolts 7 and 8 are visible). A dividing line 3 shows where the board sections separate when disassembled. To separate the sections bolts 7 and 8 are removed.

Figure 2:
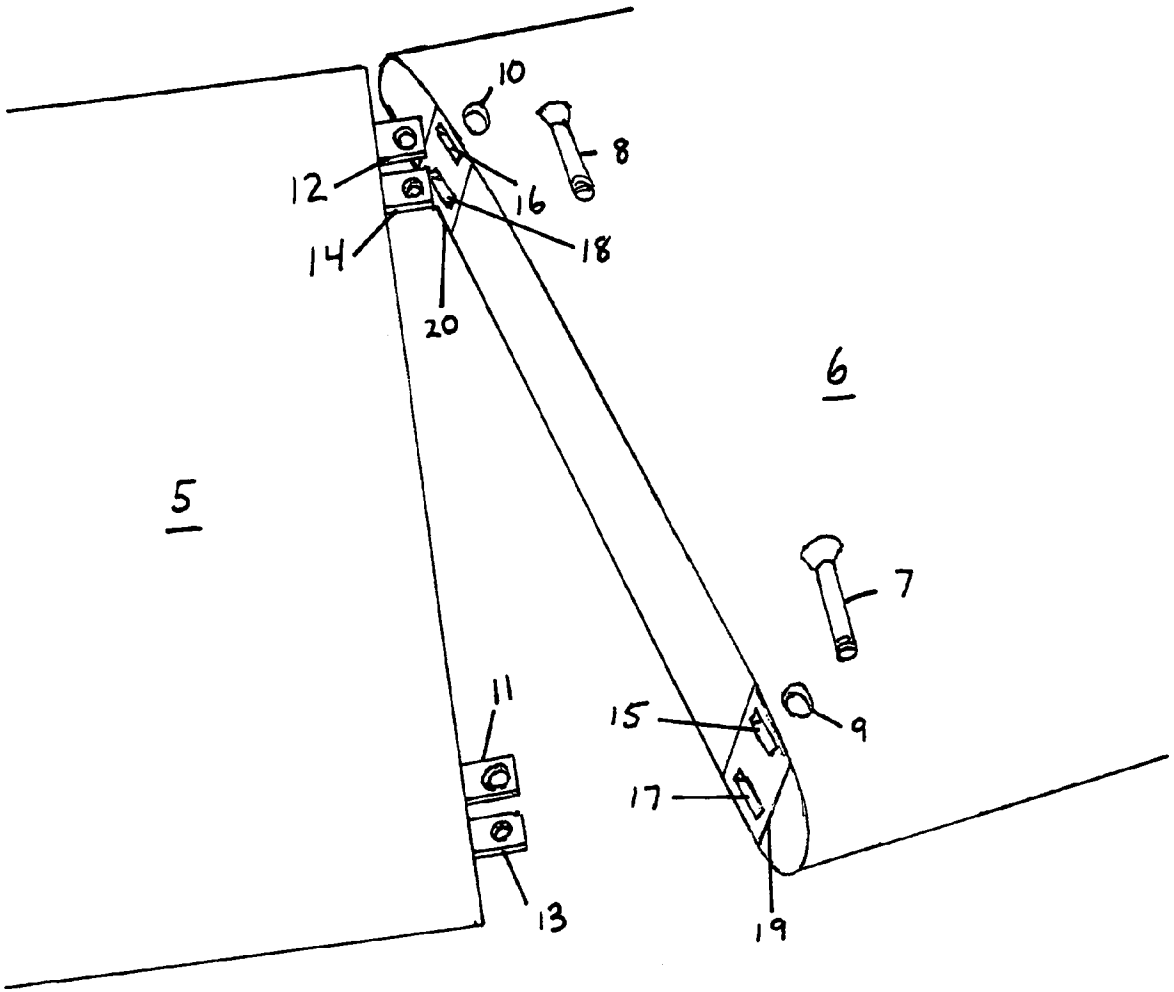
FIG. 2 is a perspective view of the center of the surfboard in FIG. 1 when disassembled showing one embodiment of the joining assembly.

FIG. 2 shows one embodiment of surfboard 1 when sections 5 and 6 are disassembled. Top metal plate 11 and bottom metal plate 13 mate into recesses 15 and 17 in molded plastic assembly 19 when sections 5 and 6 are joined. Top metal plate 12 and bottom metal plate 14 mate into recesses 16 and 18 in molded plastic assembly 20 when sections 5 and 6 are joined. Molded plastic assemblies 19 and 20, as well as the molded plastic parts in which the metal top and bottom plates 11,12,13 and 14 are embedded into (not visible), are glued into the board foam and to the top and bottom skins of the board. They are typically mounted near the side of the board as shown for strength. Joining bolts 7 and 8 pass through holes 9 and 10 in board section 6, through the holes in top metal plates 11 and 12, through a tube in molded parts 19 and 20, and are tightened into the bottom threaded hole in the bottom metal plates 13 and 14, to join sections 5 and 6.

Figure 3:
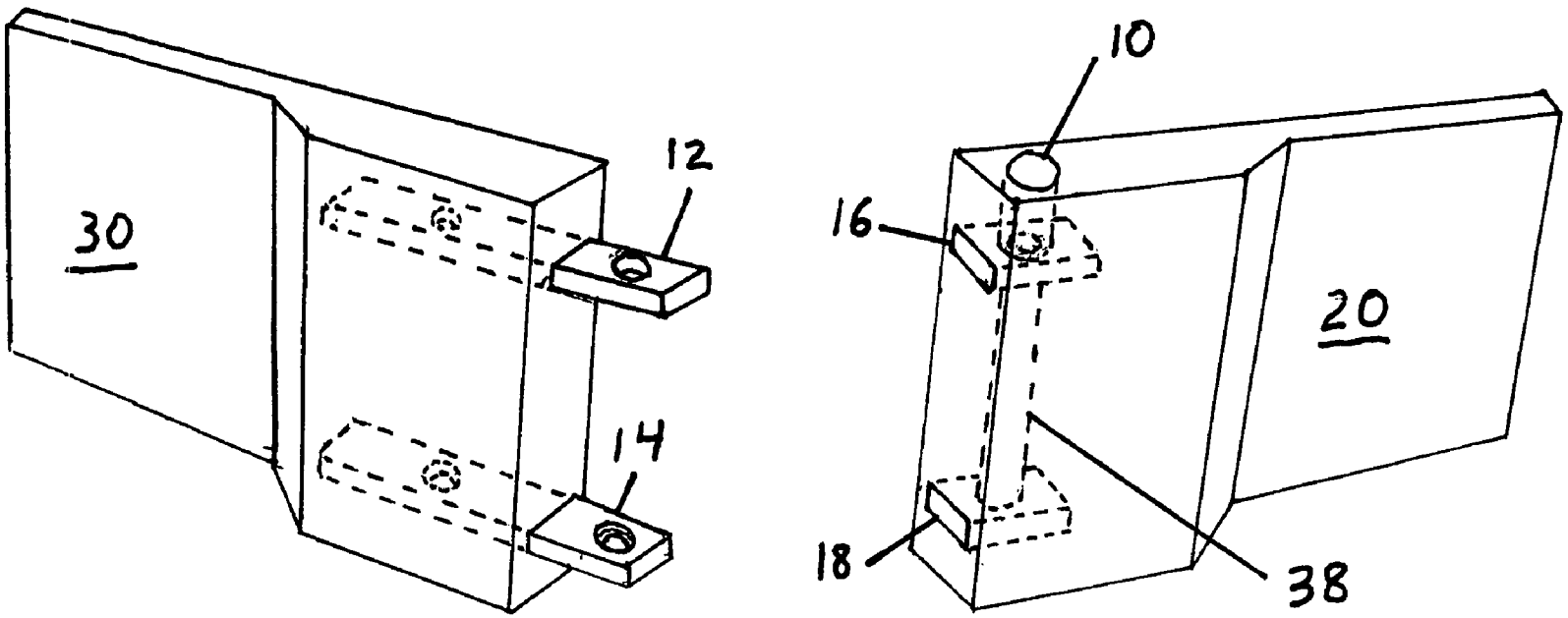
FIG. 3 is a perspective view showing both halves of one embodiment of one side of the joining assembly.

FIG. 3 shows the internal joining parts for one side of one embodiment of surfboard 1. The plastic molded assemblies are drawn with the internal parts shown with dotted lines. Molded plastic assembly 20 includes recesses 16 and 18 for the protruding metal plates of molded plastic assembly 30. The metal tube 38 is molded into molded plastic assembly 20. Molded part 30 mates into molded part 20. Top metal part 12 has a hole for the joining bolt and is also shown with a hole in the embedded part. Bottom metal part 14 has a threaded hole for the joining bolt and is also shown with a hole in the embedded part. The metal plates may have one or more holes in the embedded part to improve the bond to the plastic. For shorter boards the top plates are typically made of ⅛ inch thick stainless steel and have ¼ inch diameter holes for the joining bolts. The bottom plates are typically made of 3/16 inch thick stainless steel and have threaded holes for the joining bolts. The joining bolts are typically ¼ inch stainless steel bolts. For larger boards the bolts are typically 5/16 inch in diameter and the metal plates, and tubes are also larger.

Figure 4:
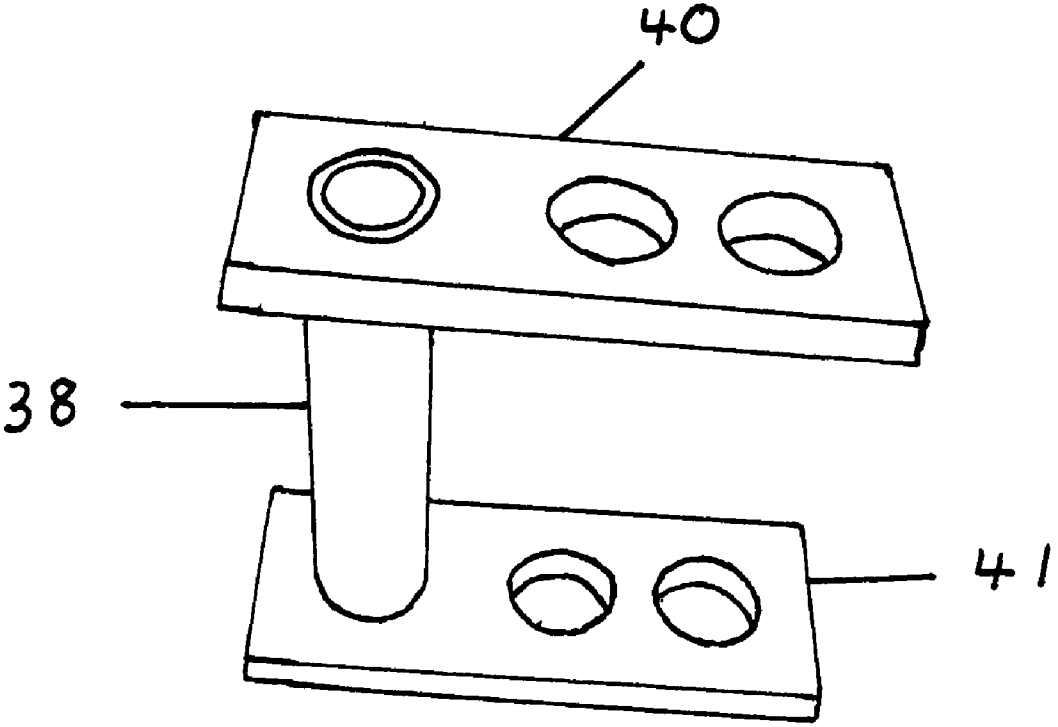
FIG. 4 is a perspective view of one embodiment showing the internal metal parts of the molded plastic assembly with tube.

FIG. 4 shows one way to improve the bond of the metal tube 38 to the molded plastic. Metal plates 40 and 41 stiffen the ends of the tube and extra holes are shown which improves the bond of the metal plates to the molded plastic.

Figure 5:
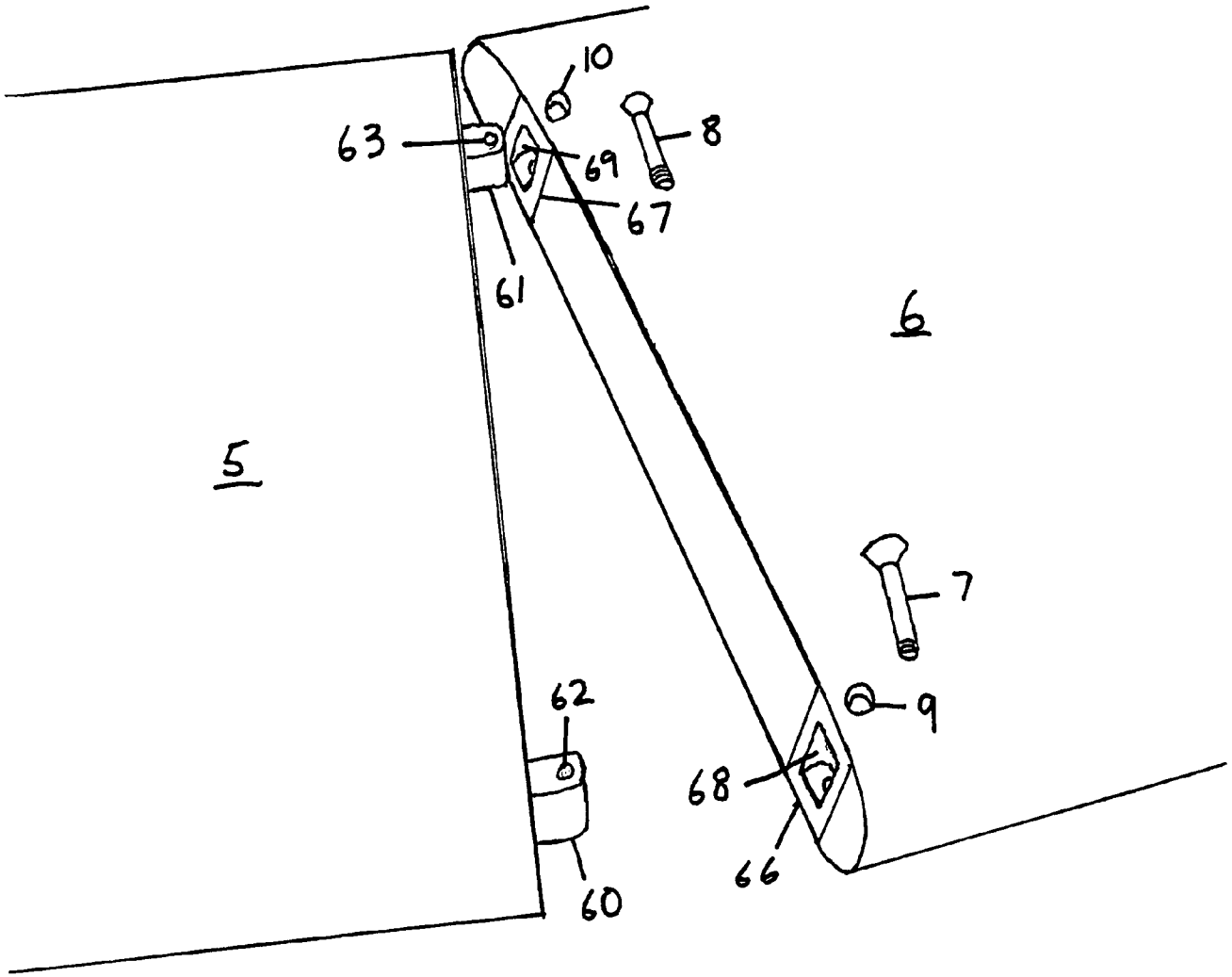
FIG. 5 is a perspective view of the center of the surfboard in FIG. 1 when disassembled showing a different embodiment of the joining assembly.

FIG. 5 shows a different embodiment of the joining assembly showing a different arrangement of the joining parts. In this embodiment the metal tubes, 62 and 63, are molded in molded plastic assemblies 60 and 61, and are protruding from the mating surface. The metal plates are molded in molded plastic parts 66 and 67, which have recesses 68 and 69 for the protruding part of molded plastic assemblies 60 and 61.

I claim:

1. A sectionalized, stringerless surfboard or windsurfer board having first and second sections, said first section detachably assembled with said second section, each said section having at least one mating surface and a plastic foam core covered with a plastic skin, a joining means having two joining bolts and two joining assemblies each mounted proximate left and right sides of said board, each said joining assembly having first and second mating joining parts, said first joining part glued in said first board section and said second joining part glued in said second board section, each of said joining parts having parts molded in a molded plastic, each said joining part glued to said foam and to said skin of the respective one of said sections;

said first joining part having a top rectangular metal plate and a bottom rectangular metal plate each partially embedded in said molded plastic with said metal plates partially protruding from said mating surface, said protruding part of said top metal plate having a hole for receiving said joining bolt and said protruding part of said bottom plate having a threaded hole for engaging said joining bolt;

said second joining part having said plastic molding with matching recesses for accommodating said top and bottom protruding metal plates of said first joining part, a tube molded inside said plastic molding, said tube fitting between said protruding metal plates of said first joining part when said joining parts are assembled, said joining bolt passing through said tube when said board sections are joined, each said joining bolt passing through a hole in said skin of said second section, a hole in said second joining part, said hole in said top metal plate of said first joining part, through said tube molded in said second joining part, and tightened in said threaded hole in said bottom metal plate of said first joining part;

wherein said board is without a stringer.

2. The board of claim 1 further including two rectangular metal plates having holes to insert said metal tube of said second joining part, said two rectangular metal plates installed at the top and bottom of said tube and molded in said second joining part to improve the bonding to said plastic molding of said second joining part and to strengthen the ends of said tube.

3. A sectionalized, stringerless surfboard or windsurfer board having first and second sections, said first section detachably assembled with said second section, each said section having at least one mating surface and a plastic foam core covered with a plastic skin, a joining means having two joining bolts and two joining assemblies each mounted proximate left and right sides of said board, each said joining assembly having first and second mating joining parts, said first joining part glued in said first board section and said second joining part glued in said second board section, each of said joining parts having parts molded in a molded plastic, each said joining part glued to said foam and to said skin of the respective one of said sections;

said first joining part having a top rectangular metal plate and a bottom rectangular metal plate molded in said molded plastic; a cavity defined in said molded plastic between said top and bottom metal plates, said top metal plate having a hole for receiving said joining bolt and said bottom plate having a threaded hole for engaging said joining bolt;

said second joining part having said plastic molding with a tube molded inside said plastic molding with said tube protruding from said mating surface, said tube fitting in said cavity between said metal plates of said first joining part when said joining parts are assembled and through which said joining bolt passes when said board sections are joined, each said joining bolt passing through a hole in said skin of said first section, a hole in said first joining part, said hole in said top metal plate of said first joining part, through said tube molded in said second joining part, and tightened in said threaded hole in said bottom metal plate of said first joining part;

wherein said board is without a stringer.

4. The board of claim 3 further including two rectangular metal plates having holes to insert said metal tube of said second joining part, said two rectangular metal plates installed at the top and bottom of said tube and molded in said second joining part to improve the bonding of said tube to said plastic molding of said second joining part and to strengthen the ends of said tube.

* * * * *